US007455283B2

(12) United States Patent
Prager

(10) Patent No.: US 7,455,283 B2
(45) Date of Patent: Nov. 25, 2008

(54) DIAPHRAGM CARBURETOR

(75) Inventor: Andre Prager, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 266 days.

(21) Appl. No.: 11/308,720

(22) Filed: Apr. 26, 2006

(65) Prior Publication Data

US 2007/0035043 A1 Feb. 15, 2007

(30) Foreign Application Priority Data

Apr. 28, 2005 (DE) ..... 10 2005 019 761

(51) Int. Cl.
*F02M 17/04* (2006.01)

(52) U.S. Cl. ..... 261/35; 261/69.1; 261/DIG. 68

(58) Field of Classification Search ..... 261/35, 261/69.1, 69.2, DIG. 68
See application file for complete search history.

(56) References Cited

U.S. PATENT DOCUMENTS 2,345,168 A * 3/1944 Wirth et al. ..... 261/23.1
2,724,584 A 11/1955 Armstrong ..... 261/69
3,072,390 A * 1/1963 Phillips ..... 261/35
3,085,791 A * 4/1963 Phillips ..... 261/35
3,268,216 A * 8/1966 Phillips ..... 261/69.1
3,330,545 A * 7/1967 Donovan ..... 261/41.5
4,230,646 A * 10/1980 Ghizzoni ..... 261/35
4,294,779 A * 10/1981 Alape ..... 261/35
4,483,302 A * 11/1984 Mannessen ..... 123/527
4,787,356 A * 11/1988 Rosgen et al. ..... 123/438
5,503,119 A * 4/1996 Glover ..... 123/73 B
5,843,345 A * 12/1998 Guntly ..... 261/34.2

* cited by examiner

*Primary Examiner*—Richard L Chiesa
(74) *Attorney, Agent, or Firm*—Gudrun E. Huckett

(57) ABSTRACT

A diaphragm carburetor for an internal combustion engine of a hand-guided power tool has a carburetor housing having an intake passage section and at least one fuel opening that opens into the intake passage section. A control chamber is arranged in the carburetor housing and supplies fuel to the at least one fuel opening. A control diaphragm delimits the control chamber. A valve controls fuel supply to the control chamber, wherein a position of the valve depends on a deflection of the control diaphragm. A device that counteracts a hydrostatic pressure difference between the at least one fuel opening and the control chamber in at least one position of the diaphragm carburetor is provided.

19 Claims, 3 Drawing Sheets

Fig. 3
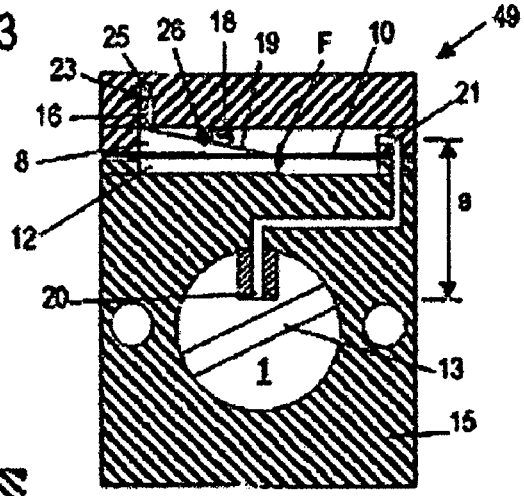
Fig. 4
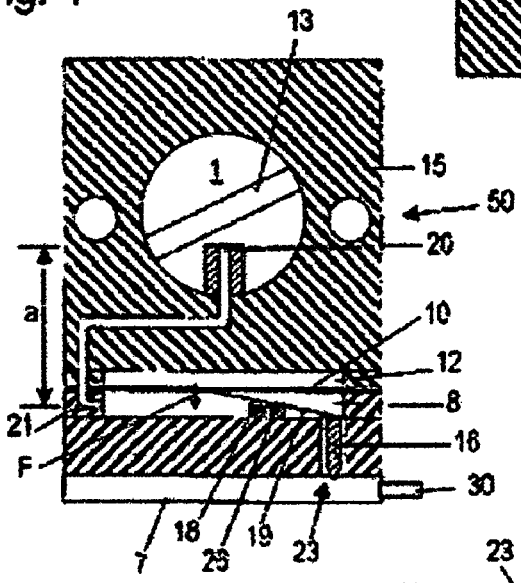
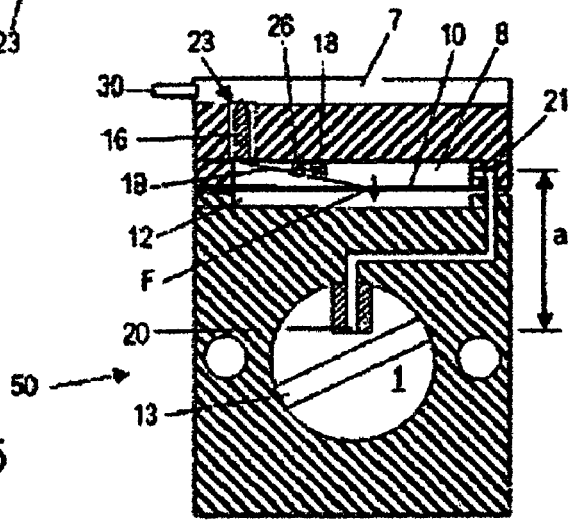
Fig. 5

DIAPHRAGM CARBURETOR

BACKGROUND OF THE INVENTION

The invention relates to a diaphragm carburetor for an internal combustion engine of a hand-guided power tool, for example, a motor chainsaw, a cut-off machine or the like. The diaphragm carburetor comprises a carburetor housing in which an intake channel section is formed into which at least one fuel opening opens, wherein fuel is supplied to the fuel opening from a control chamber that is delimited by a control diaphragm. The fuel supply into the control chamber is controlled by a valve whose position depends on the deflection of the control diaphragm.

U.S. Pat. No. 2,724,584 discloses a diaphragm carburetor having a counterweight arranged on the control diaphragm. The counterweight is provided in order to compensate the weight of the control diaphragm when pivoting the carburetor to thereby ensure a constant fuel supply.

It was found that a position-dependent change of the fuel supply occurs even for such a diaphragm carburetor in which the weight of the control diaphragm is compensated by constructive measures.

SUMMARY OF THE INVENTION

It is an object of the present invention to provide a diaphragm carburetor of the aforementioned kind in which the positional dependency of the supplied fuel amount is reduced.

In accordance with the present invention, this is achieved in that means are provided that counteract the hydrostatic pressure difference between the fuel opening and the control chamber in at least one position of the diaphragm carburetor.

It was found that not only the control diaphragm or other components of the diaphragm carburetor are responsible for fluctuations in the supplied fuel quantity but that the positional dependency also results from hydrostatic pressure difference between the fuel opening and the control chamber. In order to minimize the positional dependency of the fuel supply caused by the diaphragm carburetor, means are provided that counteract the hydrostatic pressure difference between the fuel opening and the control chamber, i.e., the pressure difference caused by the liquid column between fuel opening and control chamber, in at least one position of the diaphragm carburetor.

Accordingly, it is provided that in the control chamber a lever is pivotably supported on a pivot axis wherein a valve body is arranged on one end of the lever and the control diaphragm is arranged on the opposite end, relative to the pivot axis. In this way, a simple coupling of the position of the control diaphragm to the position of the valve body is realized. In order to counteract the influence of the hydrostatic pressure difference between the control chamber and the fuel opening, it is provided that the valve body and the control diaphragm are arranged and adjusted in such a way relative to one another that the resulting force acting on the control diaphragm counteracts the hydrostatic pressure difference between fuel opening and control chamber. The deflection of the control diaphragm causes firstly a change in pressure in the control chamber as a result of the change in volume and, secondly, a change in the control characteristics because the control diaphragm actuates the valve that controls the fuel supply into the control chamber and increases the pressure in the control chamber additionally by opening the valve. In this connection, the masses of the control diaphragm and valve body as well as the spacing relative to the pivot axis, i.e., the leverage, can be varied in order to provide an optimal arrangement and optimal adjustment. Preferably, the control diaphragm is not fixedly connected to the lever but simply rests against the lever. In this way, the movement of the control diaphragm is partially decoupled from the position of the lever and the pressure in the control chamber is independent of the weight of the valve body in positions of the diaphragm carburetor in which the control diaphragm is arranged below the lever. In positions of the diaphragm carburetor in which the control diaphragm is arranged above the lever, the pressure in the control chamber is adjusted as a function of the forces that act on the lever and are caused by the valve body and the control diaphragm. However, the lever can rest against the control diaphragm in any position of the carburetor so that a control of the valve is ensured. For obtaining the desired control characteristics, it can also be provided that the lever is attached to the control diaphragm.

Usually, the effect of the control diaphragm is greater than the effect of the valve body primarily because of the leverage. An adjustment can be achieved therefore in a simple way in that the control chamber is arranged on the side of the control diaphragm facing away from the fuel opening. In this way, the weight force of the control diaphragm counteracts the hydrostatic pressure difference between control chamber and fuel opening, i.e., the pressure difference caused by the arrangement at different heights or levels, so that the control diaphragm at least partially compensates the effect of the liquid column between fuel opening and control chamber. In conventional diaphragm carburetors, the control chamber is arranged on the side of the control diaphragm facing the fuel opening and increases the positional dependency of the supplied fuel quantity of the diaphragm carburetor. By changing the arrangement, no additional components or parts are required so that the weight of the diaphragm carburetor remains unchanged. Also, the size remains approximately the same. Since only the arrangement of the control chamber is changed, the adjustment of valve and control diaphragm, i.e., their weight as well as the arrangement relative to the pivot axis, can remain unchanged so that no complex new adjustment of the behavior of the diaphragm carburetor is required.

For conveying fuel into the control chamber, expediently a fuel pump is provided wherein the fuel pump is arranged in particular adjacent to the control chamber. By arranging the fuel pump adjacent to the control chamber, connecting passages between fuel pump and control chamber are essentially obsolete so that a simple configuration of the diaphragm carburetor results. The fuel pump is arranged in particular on the side of the control chamber facing away from the intake passage. In this way, the connecting passage that is provided for connecting fuel pump and control chamber in a conventional diaphragm carburetor where fuel pump and control chamber are arranged on opposite sides of the intake passage section is no longer required. It is provided that on the side of the control diaphragm that is facing away from the control chamber a compensation chamber is arranged in which a reference pressure is present that is, for example, ambient pressure or the pressure that is present at the clean side of the air filter.

In order to counteract the hydrostatic pressure difference between the fuel opening and control chamber, a liquid column can be provided that acts on the control diaphragm in at least one position of the diaphragm carburetor. In order to be able to decouple the effect of the liquid column onto the control diaphragm in predetermined positions of the diaphragm carburetor from the position of the control diaphragm, it is provided that the liquid column acts onto the control chamber through a first auxiliary diaphragm arranged on the side of the control diaphragm facing away from the control chamber. In this way, the control diaphragm can move independent of the auxiliary diaphragm that is arranged at the liquid column. Advantageously, the first auxiliary diaphragm delimits a liquid-filled first chamber. In particular, the surface area of the first auxiliary diaphragm matches the surface area of the control diaphragm. Since the surface areas of the diaphragms are selected to be approximately of the same size, it is also possible to achieve substantially identical deflections and substantially identical forces for the deflection. It is provided that the end of the liquid column facing away from the control diaphragm is closed off by a movable element, for example, a second auxiliary diaphragm. The movable element delimits in particular a second chamber. When the movable element is a second auxiliary diaphragm, an enlarged surface area of the diaphragm can be obtained. Accordingly, a sufficiently large deflection of the diaphragm is enabled. The liquid column is formed in particular essentially in a passage that connects the first and second chambers. By providing a connection between the two chambers in the form of a passage, the liquid quantity can be minimal so that the liquid column has only a minimal effect on the weight of the diaphragm carburetor.

BRIEF DESCRIPTION OF THE DRAWING

FIG. 3 is a schematic illustration of the first diaphragm carburetor of FIG. 2 in a second position.

FIG. 4 is a schematic illustration of a second diaphragm carburetor in a first position.

FIG. 5 is a schematic illustration of the second diaphragm carburetor of FIG. 4 in a second position.

DESCRIPTION OF THE PREFERRED EMBODIMENTS

Figure 1:
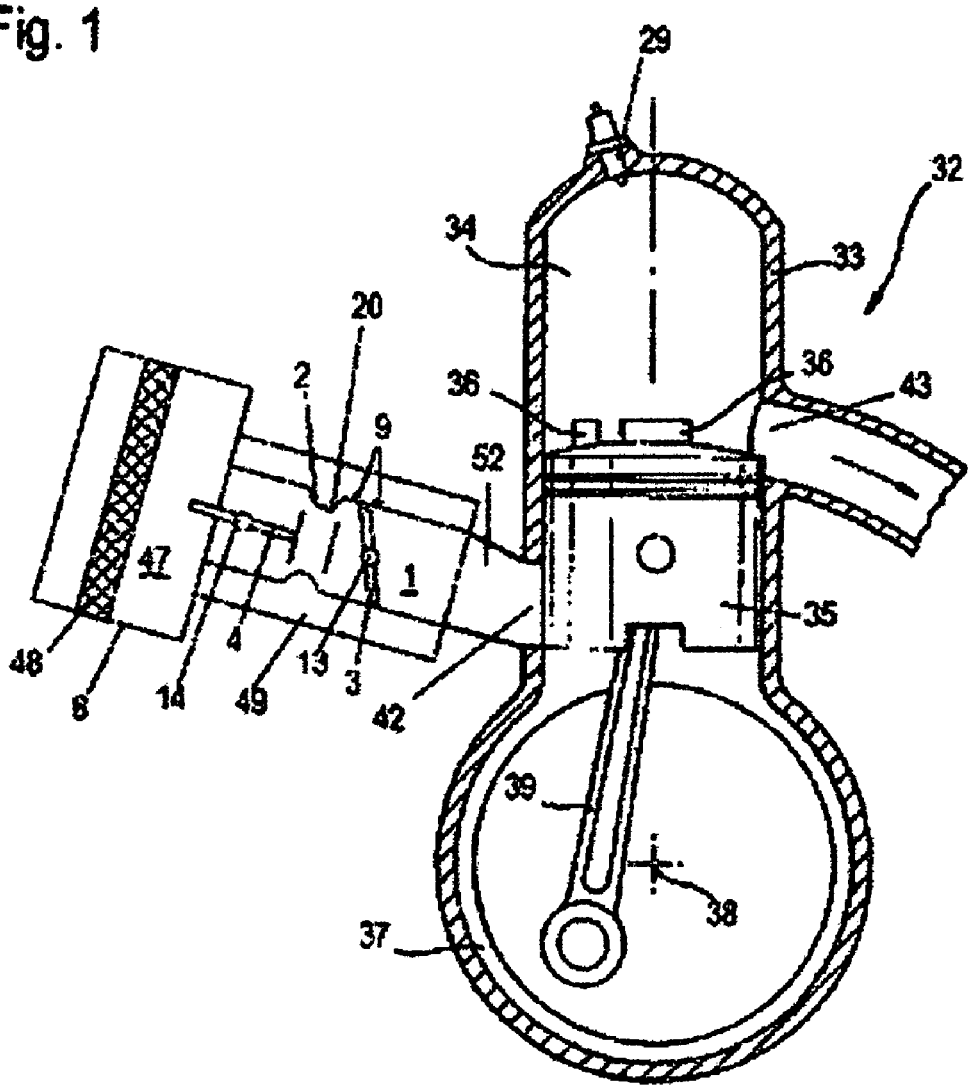
FIG. 1 is a schematic illustration of a two-stroke engine in section.

The two-stroke engine 32 illustrated in FIG. 1 has a cylinder 33 in which a combustion chamber 34 is provided. A spark plug 29 projects into the combustion chamber 34. The combustion chamber 34 is delimited by a reciprocating piston 35 that drives by means of a connecting rod 39 a crankshaft 38 rotatably supported in the crank case 37. The crank case 37 communicates via transfer passages 36 with the combustion chamber 34 when the piston 35 is in the area of the bottom dead center. The two-stroke engine 32 has an intake 42 into the crank case 37 for a fuel/air mixture and an exhaust 43 leading out of the combustion chamber 34 for removing exhaust gases. The intake 42 is connected by an intake passage 52 to the clean slide 47 of the air filter 6. The clean side 47 is separated by filter material 48 from the surroundings. The intake passage section 1 of the intake passage 52 is disposed in the diaphragm carburetor 49. In the intake passage section 1 a choke valve 4 with a choke shaft 14 and, downstream of the choke valve 4, a throttle valve 3 with a throttle shaft 13 are pivotably supported. In the intake passage section 1 a Venturi section 2 is provided and arranged approximately between the throttle valve 3 and the choke valve 4. A main fuel opening 20 opens at the Venturi section 2 into the intake passage section 1. Auxiliary fuel openings 9 open into the intake passage section 1 downstream of the Venturi section 2 at the level of the throttle valve 3.

In operation of the two-stroke engine 32, air flows out of the air filter 6 into the intake passage section 1 of the diaphragm carburetor 49. Through the fuel openings 20 and 9, fuel is supplied to the air and mixed with the air to form a fuel/air mixture. The fuel/air mixture flows through the intake 42 into the crank case 37 when the piston 35 is in the area of its top dead center. On downward stroke of the piston 35, the fuel/air mixture in the crank case 37 is compressed and flows through transfer passages 36 into the combustion chamber 34 when the piston 35 is in the area of the bottom dead center. In the combustion chamber 34, the mixture is compressed by the upwardly moving piston 35 and, when the piston 35 is in the area of the top dead center, the mixture is ignited by the spark plug 29. Combustion causes acceleration of the piston 35 in the direction toward the crank case 37. As soon as the piston 35 opens the exhaust 43, the exhaust gases flow out of the combustion chamber 34 through the exhaust 43 and fresh fuel/air mixture flows through the transfer passages 36 into the chamber 34. For separating the exhaust gases from the incoming fresh mixture, substantially fuel-free air can be interposed in the transfer passages 36; the air is supplied through an air passage. The connection of the air passage to the transfer passages can be realized, for example, by diaphragm valves or by a piston recess disposed in the piston 35.

Figure 2:
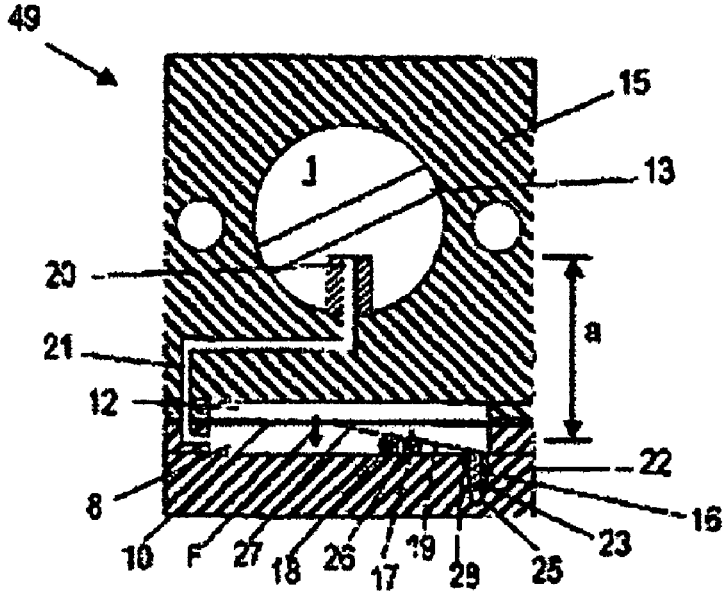
FIG. 2 is a schematic illustration of a first diaphragm carburetor in a first position.

Fuel is supplied to the main fuel opening 20 as well as to the auxiliary fuel openings 9 by a control chamber 8 (FIG. 2). The control chamber 8 is connected by a fuel passage 21 to the main fuel opening 20. The auxiliary fuel openings 9 are also connected to the control chamber 8 by passages that are not illustrated. The control chamber 8 is arranged at a longitudinal side of the intake passage section 1 in the carburetor housing 15. In the position of the diaphragm carburetor 49 illustrated in FIG. 2, the control chamber 8 is arranged below the fuel opening 20. The fuel opening 20 has therefore a height difference a relative to the control chamber 8; this results in different hydrostatic pressures at the main fuel opening 20 and in the control chamber 8. This has the result that a reduced fuel quantity is supplied to the intake passage section 1 in comparison to an arrangement of fuel opening 20 and control chamber 8 at the same heights or levels.

The control chamber 8 is delimited by a control diaphragm 10. On the side of the control diaphragm 10 facing away from the control chamber 8 a compensation chamber 12 is arranged in which a reference pressure is present. The reference pressure can be, for example, ambient pressure. However, the compensation chamber 12 is advantageously connected to the clean side 47 of the air filter 6. When the air filter 6 is soiled, the pressure at the clean slide 47 differs from ambient pressure. This pressure difference is compensated by the connection of the compensation chamber 12 to the clean slide 47 of the air filter 6 because a changed pressure on the clean slide 47 of the air filter 6 has an effect on the position of the control diaphragm 10 and thus on the supplied fuel quantity.

In the control chamber 8, a lever 19 is pivotably supported on a bearing bolt 17 about pivot axis 26. On one end 27 of the lever 19 the control diaphragm 10 is arranged. The control diaphragm 10 preferably rests against the lever 19. Between the control diaphragm and the bearing bolt 17 a spring 18 is arranged that engages the lever 19 and pretensions the control diaphragm 10 in the direction toward the compensation chamber 12. A valve body 16 of a valve 23 is secured to the end 28 of lever 19 that is positioned opposite the end 27 relative to the pivot axis 26. The valve body 16 projects into a fuel line 25 that is connected to a fuel pump (not illustrated in FIG. 2) and controls the fuel quantity that is supplied from the fuel line 25 to the control chamber 8. The control chamber 8 is essentially disposed in a control chamber lid 22; the control diaphragm 10 is secured between the carburetor housing 15 and the control chamber lid 22.

The liquid column between fuel opening 20 and control chamber 8 causes the pressure at the fuel opening 20 to be smaller than the pressure in the control chamber 8. This pressure difference is counteracted by the control diaphragm 10 because of its arrangement. The torque that is exerted by the control diaphragm 10 onto the lever 19 about pivot axis 26 is greater than the torque that is exerted by the valve body 16. The torque exerted by valve body 16 is preferably negligibly small so that the valve body 16 has no appreciable effect on the resulting force. Accordingly, the arrangement of the control chamber 8 on the side of the control diaphragm 10 facing away from the intake passage section 1 causes a resultant force F on the control diaphragm 10 that deflects the control diaphragm 10 in the direction toward the control chamber 8 and pivots the lever. 19 about the pivot axis 26. This causes the valve body 16 to open so that fuel from the fuel line 29 can flow into the control chamber 8. This leads to a pressure increase in the control chamber 8 that increases the quantity of fuel supplied to the intake passage section 1. The resultant force F and thus the deflection of the control diaphragm 10 is adjusted expediently in such a way that the increased pressure in the control chamber 8 corresponds essentially to the hydrostatic pressure difference between the fuel opening 20 and the control chamber 8. Accordingly, the effect of the position of the diaphragm carburetor 49 onto the supplied fuel quantity can be reduced and, in particular, completely compensated. The resultant torque can be caused by different weights of control diaphragm 10 and valve body 16; preferably, however, the spacing of the point of attack of the control diaphragm 10 at the lever 19 to the pivot axis 26 is greater than the spacing of the valve body 16 to the pivot axis 26 so that the control diaphragm 10 acts with its greater leverage on the lever 19. When the control diaphragm 10 rests against the lever 19, the control diaphragm 10 and the valve body 16 generate a resultant torque about the pivot axis 26 in FIG. 2 in a counterclockwise direction that is only partially compensated by the spring 18.

In FIG. 3, the diaphragm carburetor 49 is illustrated in a different position. In this position, the control chamber 8 is positioned above the intake passage section 1. The liquid column between control chamber 8 and fuel opening 20 acts at the fuel opening 20 and the hydrostatic pressure at the main fuel opening 20 is greater than in the control chamber 8 so that the amount of fuel supplied to the intake passage section 1 is increased relative to an arrangement of the fuel opening 20 and control chamber 8 at the same height or level. The increased pressure at the main fuel opening 20 is counteracted by the arrangement of the control chamber 8 on the side of the control diaphragm 10 facing away from the intake passage section 1. Because the control diaphragm 10 only rests against the lever 19 without being attached thereto, the control diaphragm 10, as a result of its weight creating a force F, is deflected in the direction toward the compensation chamber 12. The control diaphragm 10 can be lifted off the lever 19 while the valve 23 is kept in its closed position by the spring 18. However, the lever 19 preferably rests against the control diaphragm 10. By the deflection of the control diaphragm 10, the pressure in the control chamber 8 is reduced so that also the pressure at the main fuel opening 20 is reduced. In this way, the pressure difference that results from the arrangement of the fuel opening 20 and of the control chamber 8 at different heights or levels is counteracted. However, it is also possible to attach the lever 19 to the control diaphragm 10.

In FIGS. 4 and 5, a diaphragm carburetor 50 is illustrated in which the control chamber 8 is also arranged at the side of the control diaphragm 10 facing away from the intake passage section 1. A fuel pump 7 is arranged adjacent to the control chamber 8 and supplies the control chamber 8 with fuel. The valve body 16 of the valve 23 is arranged directly on the fuel pump 7. In this way, the diaphragm carburetor 50 is provided with a short supply path and a simple configuration. For receiving the fuel, the fuel pump 7 has a fuel connector 30. The fuel pump 7 can be configured, for example, as a diaphragm pump and can be driven by the fluctuating pressure in the crank case 37.

In order to be able to properly compensate the positional dependency of the diaphragm carburetor 50, the weight of the control diaphragm 10, the weight distribution of the lever 19, the weight of the valve body 16, the spring 18 as well as the arrangement of the pivot axis 26 of the lever 19 can be adjusted such that the resultant force F acting on the control diaphragm 10 counteracts the pressure difference as a result of the height difference a between the fuel opening 20 and control chamber 8 and, in particular, compensate it as much as possible. In this connection, in particular the effect of the weight of the control diaphragm 10 is decisive while the other parameters have a negligibly small effect. The position of the diaphragm carburetor 50 illustrated in FIG. 4 corresponds to the position of the diaphragm carburetor 49 in FIG. 2. The pressure at the fuel opening 20 is smaller than the pressure in the control chamber 8. The control diaphragm 10 rests against the lever 19 and a resultant moment is generated at the lever 19 about the pivot axis 26 in FIG. 4 in a counterclockwise direction.

The resultant force F at the control diaphragm 10 deflects the control diaphragm 10 in the direction toward the control chamber 8. The valve body 16 is moved and opens the valve 23 so that the fuel from the fuel pump 7 flows into the control chamber 8. In this way, the pressure in the control chamber 8 and thus also at the fuel opening 20 is increased so that the fuel quantity supplied to the intake passage section 1 is increased. The control diaphragm 10 compensates in this way the effect of the liquid column between control chamber 8 and fuel opening 20 at least partially.

In the position of the diaphragm carburetor 50 illustrated in FIG. 5 that corresponds to the position of the carburetor 49 illustrated in FIG. 3, the main fuel opening 20 is arranged below the control chamber 8 so that the hydrostatic pressure at the main fuel opening 20 is greater than the pressure in the control chamber 8. The weight of the control diaphragm 10 generates a force F on the control diaphragm 10. The control diaphragm 10 is deflected as a result of the force F acting in the direction toward the compensation chamber 12. The control diaphragm 10 can be lifted off the lever 19 and the valve 23 remains closed because of the force action of the spring 18. However, the lever 19 can still rest against the control diaphragm 10 even when the control diaphragm 10 is deflected. Because of the deflection of the control diaphragm 10, the pressure in the control chamber 8 is reduced. The thus reduced pressure at the main fuel opening 20 causes a reduction of the fuel quantity being supplied to the intake passage section 1 so that the arrangement of the control diaphragm 10 compensates the effect of the liquid column between control chamber 8 and fuel opening 20 at least partially.

Figure 6:
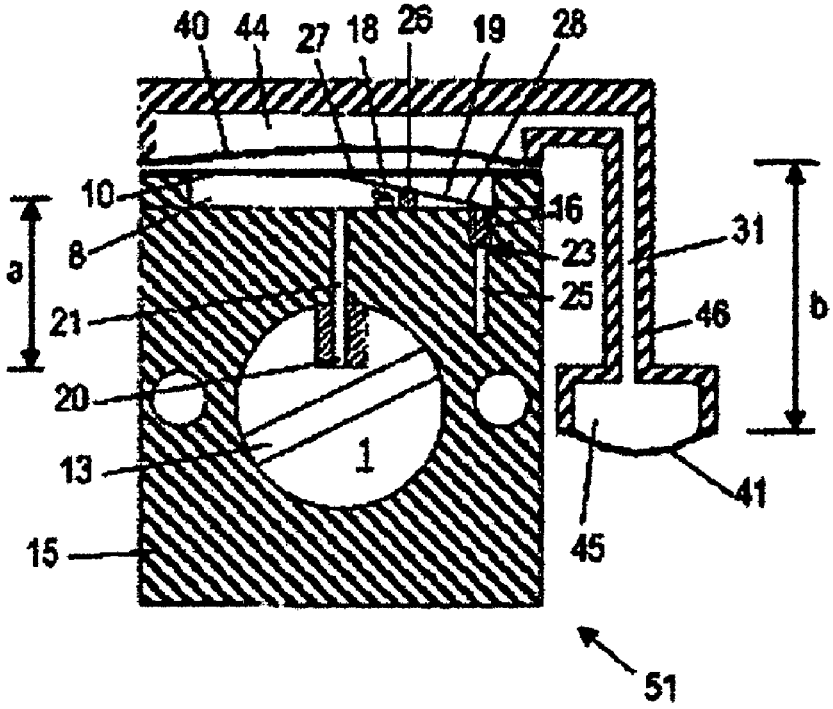
FIG. 6 is a schematic illustration of a third diaphragm carburetor in a first position.
Figure 7:
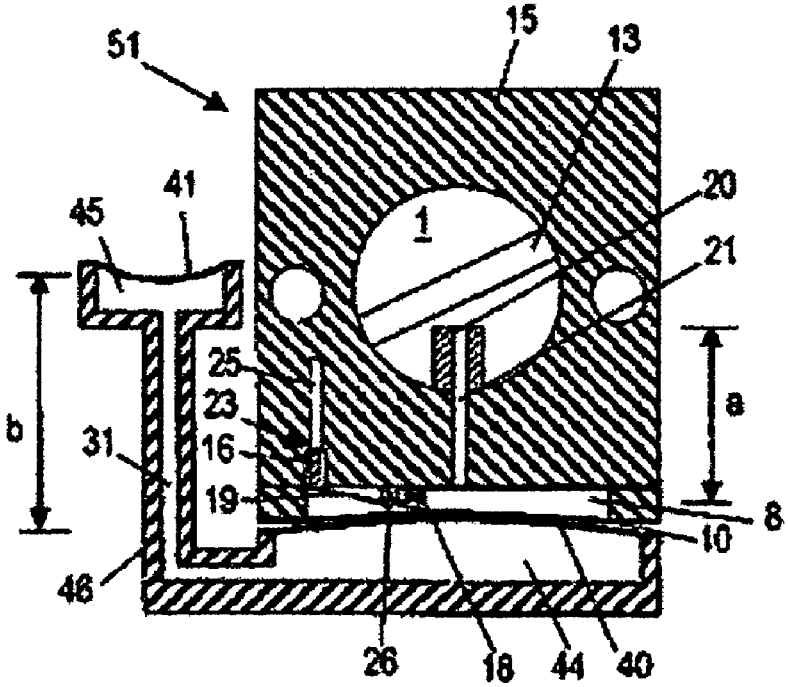
FIG. 7 is a schematic illustration of the third diaphragm carburetor of FIG. 6 in a second position.

FIGS. 6 and 7 show a diaphragm carburetor 51 in different positions. The control chamber 8 of the diaphragm carburetor 51 is arranged on the side of the control diaphragm 10 facing the intake passage section 1. In the control chamber 8 a lever 19 is supported to be pivotable about pivot axis 26 and is secured with the end 27 on the control diaphragm 10. Valve body 16 of the valve 23 is arranged at the opposite end 28 of the lever 19. The valve body 16 projects into a fuel line 25 into which fuel is supplied by the fuel pump, not illustrated. On the side of the control diaphragm 10 facing away from the control chamber 8, a first chamber 44 is arranged which is delimited by a first auxiliary diaphragm 40. The first auxiliary diaphragm 40 is arranged adjacent to the control diaphragm 10. The size of the first auxiliary diaphragm 40 matches approximately the size 8 (surface area) of the control diaphragm 10. Preferably, the diaphragms 10 and 40 are made from the same material or similar material so that comparable elasticity values and thus comparable deflections are achieved. The first chamber 44 is connected by a passage 46 to a second chamber 45. The chambers 44 and 45 as well as the passage 46 are filled with a liquid. The second chamber 45 is delimited by a second auxiliary diaphragm 41. The second chamber 45, however, can also be delimited by a different movable element, for example, a piston or the like. The second auxiliary diaphragm 41 can be smaller than the first auxiliary diaphragm 40; however, it can also be advantageous that both diaphragms 40, 41 have approximately the same size (surface area). The second chamber 45 is arranged approximately at the level of the main fuel opening 20 adjacent to the intake passage section 1. Between the diaphragms 40 and 41 there is thus a height difference b.

In the position of the diaphragm carburetor 51 illustrated in FIG. 6, the control chamber 8 is arranged above the intake passage section 1. The first chamber 44 is arranged above the control chamber 8 and the second chamber 45 is arranged approximately at the level of the main fuel opening 20. The liquid in the second chamber 45 and in the passage 46 forms a liquid column 31. Since the hydrostatic pressure in the second chamber 45 is greater than in the first chamber 44, the liquid column 31 exerts a force onto the second auxiliary diaphragm 41 that causes the second auxiliary diaphragm 41 to curve outwardly. This causes a deflection of the first auxiliary diaphragm 40 toward the interior, i.e. in the direction toward the first chamber 44. The first auxiliary diaphragm 40 therefore does not affect the deflection of the control diaphragm 10 in this position of the diaphragm carburetor 51.

In FIG. 7, the diaphragm carburetor 51 is shown in a different position in which the control chamber 8 is arranged below the intake passage section 1 at a height difference a relative to the main fuel opening 20. On the side of the control diaphragm 10 that is facing away from the intake passage section 1, the first auxiliary diaphragm 40 is arranged that delimits the first chamber 44. The second chamber 45 is arranged above the first chamber 44 approximately at the level of the main fuel opening 20. As a result of the height difference b between the diaphragms 40 and 41 that determines the height of the liquid column 31, the liquid column 31 generates in this position of the diaphragm carburetor 51 an increased pressure in the first chamber 44 that leads to the second auxiliary diaphragm 41 curving inwardly and the first auxiliary diaphragm 40 curving outwardly as a result of the increased pressure. The first auxiliary diaphragm 40 acts on the control diaphragm 10 and deflects the control diaphragm 10 in the direction toward the control chamber 8. The valve 23 opens so that fuel can flow through the fuel line 25 into the control chamber 8. In this way, the pressure in the control chamber 8 is increased. This leads to an increased fuel supply through the fuel passage 21 and the main fuel opening 20 into the intake passage section 1.

The liquid column 31 therefore acts on the control diaphragm 10 in the case of the control chamber being arranged below the intake passage section 1 and effects a pressure increase in the control chamber 8. When arranging the control chamber 8 above the intake passage section 1, the liquid column 31 does not act on the control diaphragm 10 and therefore does not have an effect on its deflection. In the position of the diaphragm carburetor 51 illustrated in FIG. 7, the liquid column 31 thus counteracts the hydrostatic pressure difference between control chamber 8 and main fuel opening 20 as well as the auxiliary fuel openings 9 that are also supplied with fuel from the control chamber 8.

The specification incorporates by reference the entire disclosure of German priority document 10 2005019 761.2 having a filing date of Apr. 28, 2005.

While specific embodiments of the invention have been shown and described in detail to illustrate the inventive principles, it will be understood that the invention may be embodied otherwise without departing from such principles.

What is claimed is:

1. A diaphragm carburetor for an internal combustion engine of a hand-guided power tool, the diaphragm carburetor comprising:

a carburetor housing having an intake passage section;

at least one fuel opening that opens into the intake passage section;

a control chamber supplying fuel to the at least one fuel opening;

a control diaphragm delimiting the control chamber;

a valve controlling fuel supply to the control chamber, wherein a position of the valve depends on a deflection of the control diaphragm;

a device counteracting a hydrostatic pressure difference between the at least one fuel opening and the control chamber in at least one position of the diaphragm carburetor.

2. The diaphragm carburetor according to claim 1, wherein the device comprises a lever supported in the control chamber so as to be pivotable about a pivot axis, wherein the lever has a first end and a second end positioned opposite one another relative to the pivot axis, wherein the valve has a valve body arranged on the first end of the lever, wherein the control diaphragm is arranged on the second end of the lever.

3. The diaphragm carburetor according to claim 1, wherein the control chamber is arranged on a side of the control diaphragm facing away from the at least one fuel opening.

4. The diaphragm carburetor according to claim 1, further comprising a fuel pump supplying fuel into the control chamber, wherein the fuel pump is arranged adjacent to the control chamber.

5. The diaphragm carburetor according to claim 4, wherein the fuel pump is arranged on a side of the control chamber facing away from the intake passage section.

6. The diaphragm carburetor according to claim 1, further comprising a compensation chamber arranged on a side of the control diaphragm facing away from the control chamber, wherein a reference pressure is present in the compensation chamber.

7. The diaphragm carburetor according to claim 1, wherein the device comprises a liquid column acting on the control diaphragm to counteract the hydrostatic pressure difference between the at least one fuel opening and the control chamber in the at least one position of the diaphragm carburetor.

8. The diaphragm carburetor according to claim 1, wherein the device causes a deflection of the control diaphragm which deflection compensates substantially the hydrostatic pressure difference between the at least one fuel opening and the control chamber by increasing or decreasing a pressure in the control chamber.

9. The diaphragm carburetor according to claim 1, wherein the device minimizes positional dependency of the fuel supply.

10. A diaphragm carburetor for an internal combustion engine of a hand-guided power tool, the diaphragm carburetor comprising:

a carburetor housing having an intake passage section;

at least one fuel opening that opens into the intake passage section;

a control chamber supplying fuel to the at least one fuel opening;

a control diaphragm delimiting the control chamber;

a valve controlling fuel supply to the control chamber, wherein a position of the valve depends on a deflection of the control diaphragm;

a device counteracting a hydrostatic pressure difference between the at least one fuel opening and the control chamber in at least one position of the diaphragm carburetor;

wherein the device comprises a lever supported in the control chamber so as to be pivotable about a pivot axis, wherein the lever has a first end and a second end positioned opposite one another relative to the pivot axis, wherein the valve has a valve body arranged on the first end of the lever, wherein the control diaphragm is arranged on the second end of the lever; and wherein the valve body and the control diaphragm are arranged and adjusted relative to one another such that a resulting force acting on the control diaphragm counteracts the hydrostatic pressure difference between the at least one fuel opening and the control chamber.

11. The diaphragm carburetor according to claim 10, wherein the control diaphragm rests against the lever.

12. The diaphragm carburetor according to claim 10, wherein the control diaphragm is attached to the lever.

13. A diaphragm carburetor for an internal combustion engine of a hand-guided power tool, the diaphragm carburetor comprising:

a carburetor housing having an intake passage section;

at least one fuel opening that opens into the intake passage section;

a control chamber supplying fuel to the at least one fuel opening;

a control diaphragm delimiting the control chamber;

a valve controlling fuel supply to the control chamber, wherein a position of the valve depends on a deflection of the control diaphragm;

a device counteracting a hydrostatic pressure difference between the at least one fuel opening and the control chamber in at least one position of the diaphragm carburetor;

wherein the device comprises a liquid column acting on the control diaphragm to counteract the hydrostatic pressure difference between the at least one fuel opening and the control chamber in the at least one position of the diaphragm carburetor; and wherein the device comprises a first auxiliary diaphragm arranged on a side of the control diaphragm facing away from the control chamber, wherein the liquid column acts through the first auxiliary diaphragm onto the control diaphragm.

14. The diaphragm carburetor according to claim 13, wherein the first auxiliary diaphragm delimits a first liquid-filled chamber.

15. The diaphragm carburetor according to claim 13, wherein a surface area of the first auxiliary diaphragm matches approximately a surface area of the control diaphragm.

16. The diaphragm carburetor according to claim 13, wherein the device comprises a moveable element that closes off an end of the liquid column facing away from the control diaphragm.

17. The diaphragm carburetor according to claim 16, wherein the movable element is a second auxiliary diaphragm.

18. The diaphragm carburetor according to claim 16, wherein the movable element delimits a second chamber.

19. The diaphragm carburetor according to claim 18, wherein the first auxiliary diaphragm delimits a first chamber, wherein the first chamber and the second chamber are connected by a passage and wherein the liquid column is disposed substantially in the passage.

* * * * *